US008581503B1

(12) United States Patent
Tuffyas

(10) Patent No.: US 8,581,503 B1
(45) Date of Patent: Nov. 12, 2013

(54) METHOD OF FORMING AN LED CONTROL CIRCUIT AND STRUCTURE THEREFOR

(75) Inventor: Eric B. Tuffyas, Phoenix, AZ (US)

(73) Assignee: Semiconductor Components Industries, LLC, Phoenix, AR (US)

( * ) Notice: Subject to any disclaimer, the term of this patent is extended or adjusted under 35 U.S.C. 154(b) by 78 days.

(21) Appl. No.: 13/462,335

(22) Filed: May 2, 2012

(51) Int. Cl.
*H05B 37/02* (2006.01)

(52) U.S. Cl.
USPC ..... 315/192; 315/307; 315/200 R; 315/127

(58) Field of Classification Search
USPC ..... 315/192, 200 R, 205, 185 R, 127, 291, 315/307
See application file for complete search history.

(56) References Cited

U.S. PATENT DOCUMENTS

| | | | | |
|---|---|---|---|---|
| 7,872,427 | B2 | 1/2011 | Scianna | |
| 2013/0009616 | A1 * | 1/2013 | Chang et al. | 323/241 |
| 2013/0049631 | A1 * | 2/2013 | Riesebosch | 315/291 |
| 2013/0106298 | A1 * | 5/2013 | Datta et al. | 315/186 |
| 2013/0193879 | A1 * | 8/2013 | Sadwick et al. | 315/307 |
| 2013/0229215 | A1 * | 9/2013 | Sadwick | 327/164 |

OTHER PUBLICATIONS

Application Note, "AND8463/D 11 Watt TRIAC Dimmable PAR30 LED Lamp Driver", Jim Young, Copyright Semiconductor Components Industries, LLC, 2010, Jul. 2010—Rev. 1, 10 pgs.

* cited by examiner

*Primary Examiner* — Don Le
(74) *Attorney, Agent, or Firm* — Robert F. Hightower

(57) ABSTRACT

In one embodiment, an LED control circuit is configured to form an LED current for operating an LED light source and configured to form a bias current for a dummy load. The LED control circuit is configured to terminate the bias current responsively to detecting the LED current.

17 Claims, 6 Drawing Sheets

METHOD OF FORMING AN LED CONTROL CIRCUIT AND STRUCTURE THEREFOR

BACKGROUND OF THE INVENTION

The present invention relates, in general, to electronics, and more particularly, to semiconductors, structures thereof, and methods of forming semiconductor devices.

In the past, the electronics industry utilized various circuits to control the intensity of light emitted from a light emitting diode (LED) light source. In some embodiments, an adjustable triac dimmer was used to chop an a.c. signal in order to control the amount of current supplied to the LED light source. Such control was commonly referred to as phase control or phase-cut dimming. Controlling the amount of current facilitated controlling the intensity of the light produced by the LED light source. A control circuit usually was used to further control the LED current. The control circuit generally was also used to form a bias current to keep the adjustable triac dimmer operating. However, the bias current increased the power dissipation of the light control system.

Accordingly, it is desirable to have a method and circuit that facilitates operating an LED light source and that assists in reducing power dissipation of the associated LED lighting system.

Figure 1:
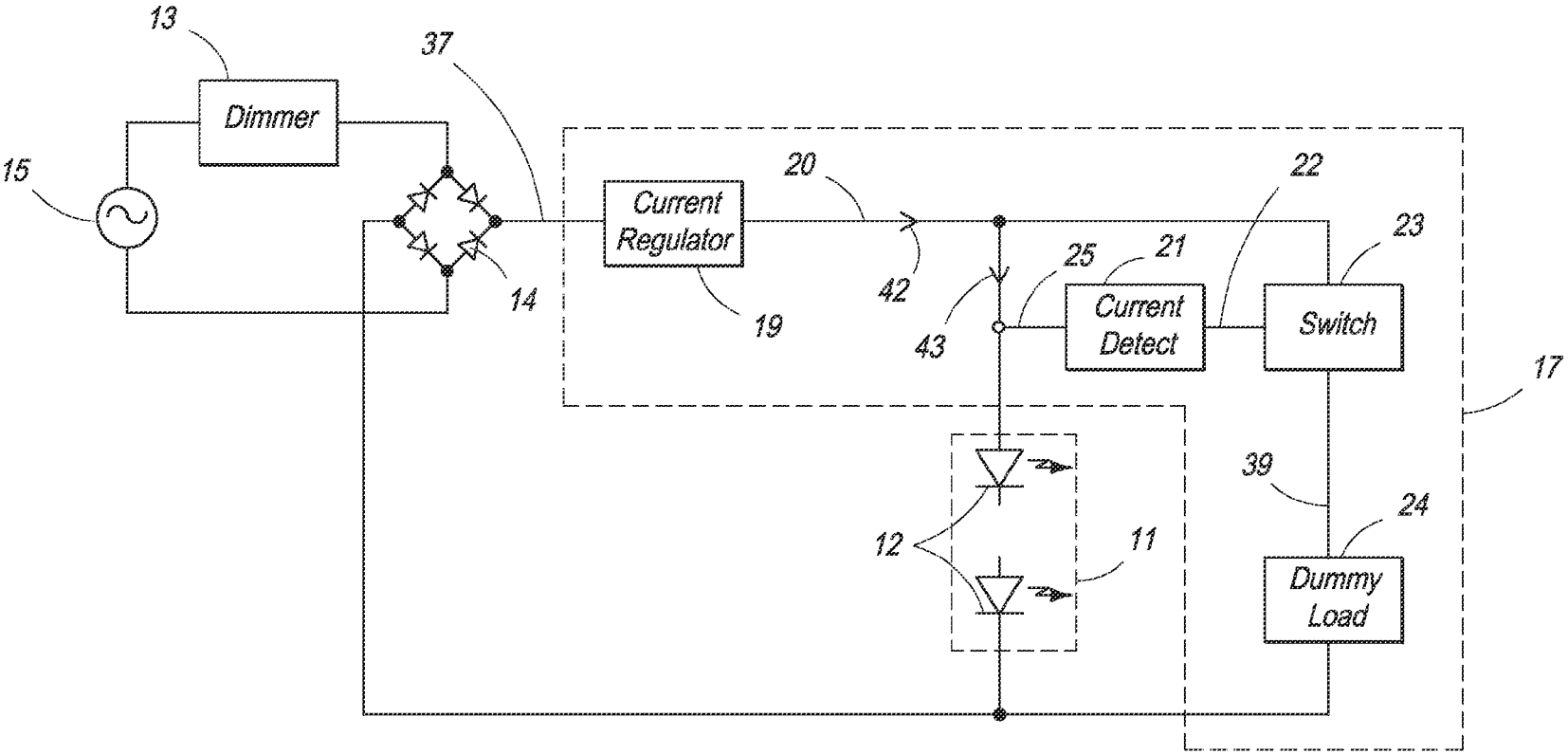
FIG. 1 schematically illustrates an example of a portion of an embodiment of a light emitting diode (LED) lighting system that includes an LED control circuit in accordance with the present invention.

For simplicity and clarity of the illustration(s), elements in the figures are not necessarily to scale, and the same reference numbers in different figures denote the same elements, unless stated otherwise. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, and that conductivity type does not refer to the doping concentration but the doping type, such as P-type of N-type. It will be appreciated by those skilled in the art that the words during, while, and when as used herein relating to circuit operation are not exact terms that mean an action takes place instantly upon an initiating action but that there may be some small but reasonable delay, such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION OF THE DRAWINGS

FIG. 1 schematically illustrates an example of an embodiment of a portion of a light emitting diode (LED) lighting system 10 that includes an LED light source 11. Source 11 typically includes a plurality of LEDs that are connected in series, such as illustrated by LEDs 12. Source 11 may also include other strings of series connected LEDs in parallel with the string of LEDs 12. System 10 includes an a.c. power source 15 such as a household mains or other source of a.c. power. A dimmer 13, such as an adjustable triac controllable dimmer, may be utilized to form a phase-cut a.c. signal in order to vary the amount of power coupled from source 15 to source 11. Those skilled in the art will understand that a dimmer circuit or dimmer 13, such as an adjustable triac controllable dimmer, receives an a.c. signal, such as from source 15, and forms a phase-cut a.c. waveform on an output of the dimmer (see plot 61 of FIG. 3 for an example illustration).

A bridge rectifier or bridge 14 generally is used to rectify the a.c. signal from dimmer 13 to provide an input signal for operating system 10. An LED control circuit 17 receives the input signal and supplies a current for operating source 11.

Circuit 17 typically includes a current regulator 19, a current detect circuit 21, and a dummy load circuit or dummy load 24 in parallel with source 11. An optional switch 23 may be included in some embodiments. Circuit 17 typically forms a current sense signal 22 and a current detect signal 25. Configuring circuit 17 includes configuring an LED control circuit to detect an LED current flowing through an LED light source and to not form a bias current while the LED current is flowing (for example, flowing sufficiently to form visible light from the LED light source) and configuring an LED control circuit to detect the absence of the LED current flowing through the LED light source (for example detect current less than a value sufficient to form visible light from the LED light source) and to responsively form the bias current. When the voltage of the input signal received by circuit 17 from bridge 14 is less than a threshold voltage for operating source 11, switch 23 is closed and load 24 conducts a bias current from regulator 19 that is sufficient to provide proper operation for dimmer 13. When the voltage of the input signal is sufficient to operate source 11, current detect circuit 21 senses a current flow through source 11 and responsively forms a control signal or current detect signal 22 representing the detection of the current. Switch 23 receives the control signal and opens switch 23 responsively to detecting the current through source 11 thereby preventing current flow through load 24. Because there is no current flow through switch 23 and load 24 while source 11 is conducting current to emit light, the power dissipation resulting from the operation of circuit 17 is reduced. Additionally, detecting current flow through source 11 to responsively terminate current flow through load 24 facilitates forming circuit 17 with an operation that is independent of the value of the threshold voltage of source 11, thus, does not depend on the threshold voltage of source 11 and therefore is not dependent on the number of LEDs that are connected in series.

Figure 2:
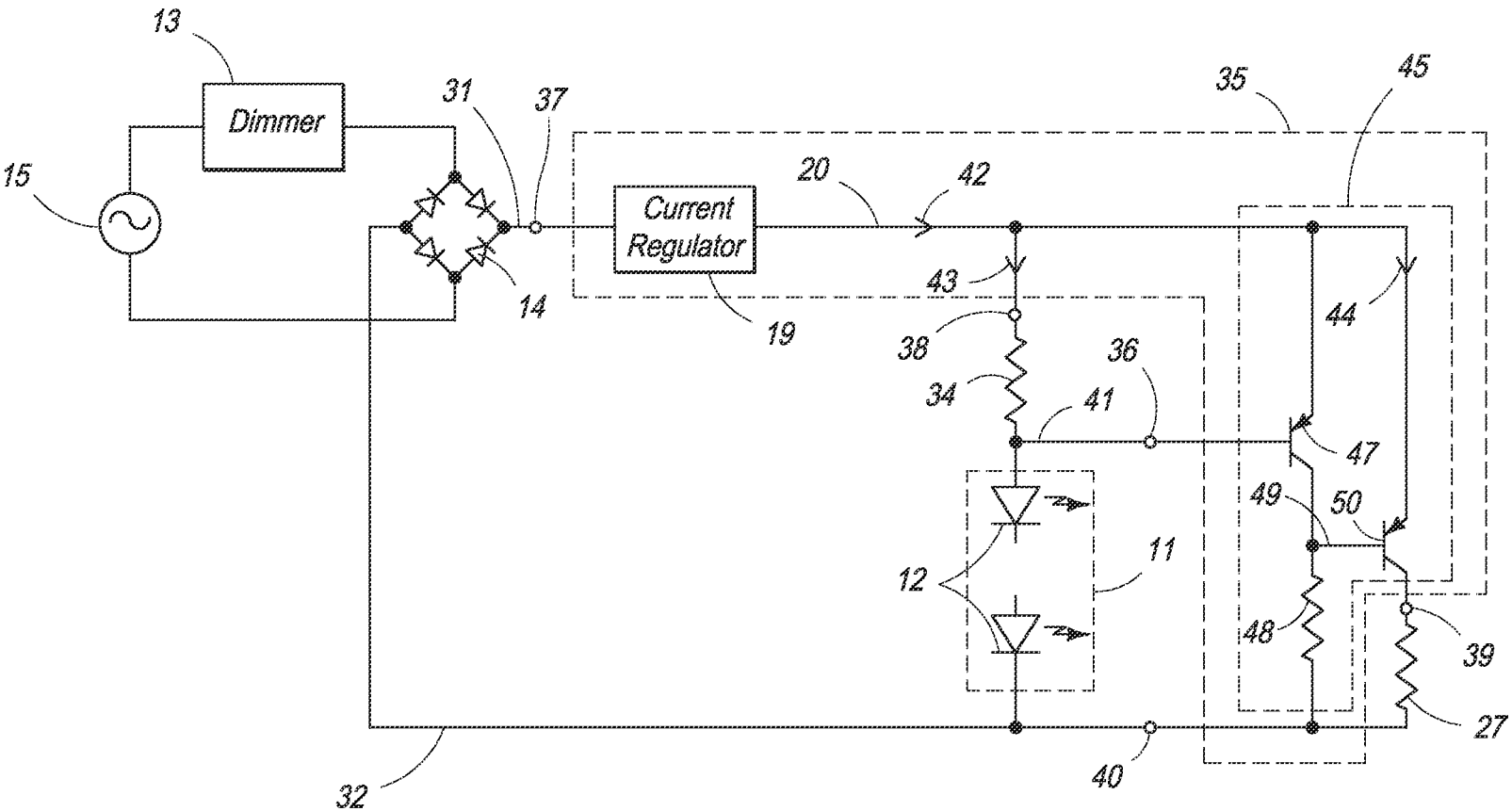
FIG. 2 schematically illustrates an example of a portion of an embodiment of a light emitting diode (LED) lighting system that is an alternate embodiment of the system of FIG. 1 in accordance with the present invention.

FIG. 2 schematically illustrates an example of an embodiment of a portion of an LED lighting system 30 that operates similarly to system 10 that was described in the explanation of FIG. 1. System 30 includes an LED control circuit 35 that is configured to operate similarly to circuit 17. Circuit 35 is configured to receive the input signal from bridge 14, such as an input signal received from an output 31 of bridge 14, and supply a current for operating source 11. Circuit 35 is configured to selectively form an LED current 43 for operating source 11 and configured to selectively form a bias current 44 that provides proper operation for dimmer 13. A current 42 formed by regulator 19 includes both of currents 43 and 44. Circuit 35 includes an input 37 that is configured to receive the input signal from bridge 14, an LED output terminal or LED output 38 configured to supply LED current 43 to source 11, a common return 40, a current sense input 36, and a load output 39 that is configured to be connected to a load 27 (illustrated in this embodiment by a resistor). Return 40 may be connected to a common return 32 from bridge 14. Load 27 operates similarly to load 24 of FIG. 1. Circuit 35 further includes regulator 19 and a control circuit 45 that is configured to selectively form current 44 or terminate current 44 responsively to a value of current 43. Circuit 45 includes a current detect circuit that operates similarly to circuit 21 of FIG. 1 and a switch circuit that operates similarly to switch 23 of FIG. 1. The current detect circuit includes a transistor 47 configured to receive a current sense signal 41 from input 36 and a resistor 48. Signal 41 is similar to signal 25. The switch circuit includes a switch transistor 50 that is configured to selectively terminate current 44 or to form current 44 for load 27 responsively to, respectively, detecting current 43 or not detecting current 43, such as current 43 being greater than a value when light source 11 is enabled.

Those skilled in the art will appreciate that in some embodiments load 24 and circuit 21 may be external to circuit 17.

Figure 3:
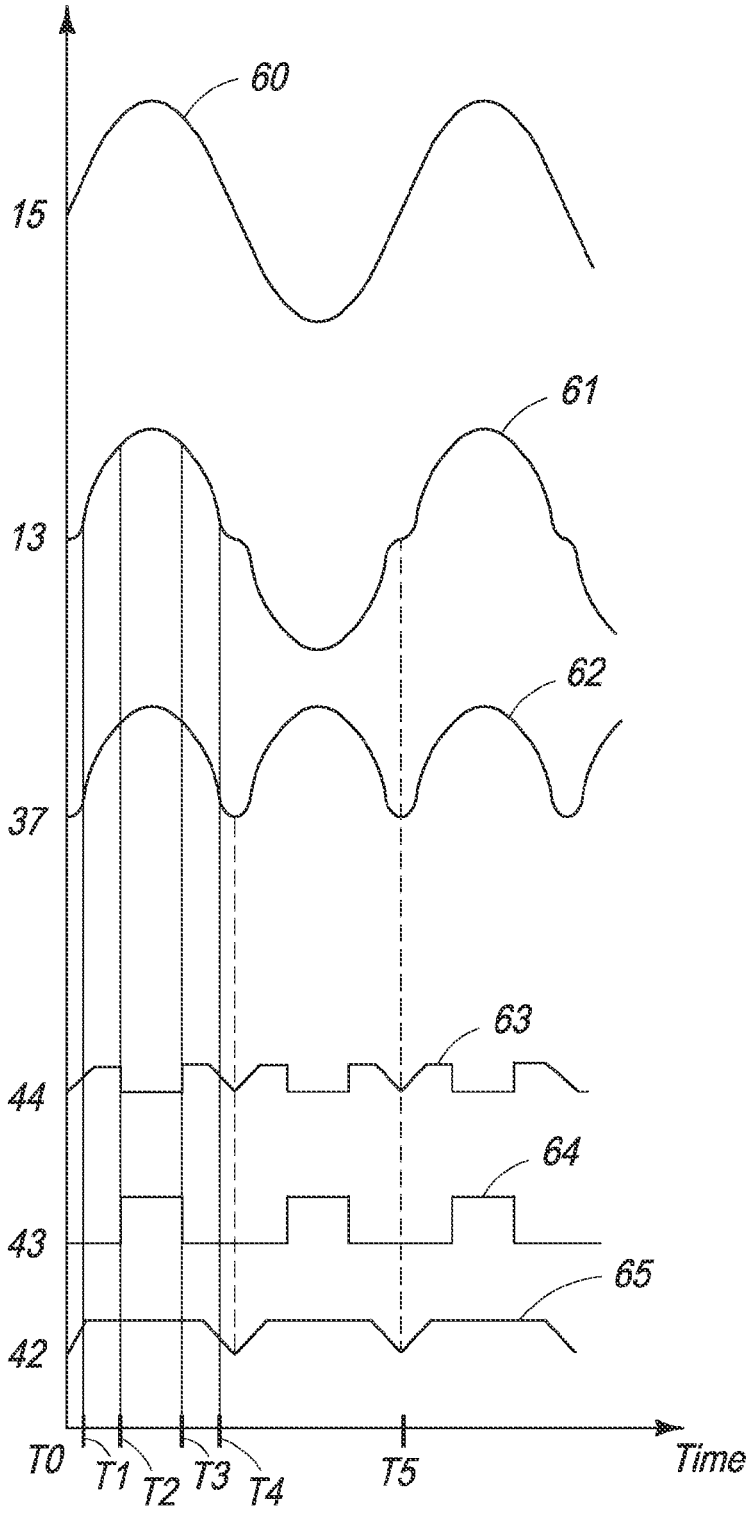
FIG. 3 is a graph having plots that illustrate some of the signals associated with the operation of the systems of FIG. 1 and FIG. 2 in accordance with the present invention.

FIG. 3 is a graph having plots that illustrate some of the signals associated with the operation of system 30. The abscissa indicates time and the ordinate indicates increasing value of the corresponding signal. A plot 60 illustrates the a.c. voltage waveform from source 15. A plot 61 illustrates one example of a chopped a.c. voltage waveform on the output of dimmer 13 for the case where dimmer 13 operates as a front end dimmer and is operating at substantially a one hundred per-cent (100%) conduction angle and dimmer 13 has not begun to phase cut the input signal. A plot 62 illustrates the waveform of the rectified voltage of the input signal on output 31 of bridge 14 with a front end type of dimmer in series with source 15. A plot 63 illustrates current 44, a plot 64 illustrates current 43, and a plot 65 illustrates current 42 that is supplied by current regulator 19. This description has references to FIG. 2 and FIG. 3. Those skilled in the art will appreciate that dimmer 13 may be any one of several well-known types of dimmers instead of a front end dimmer, such as a back-end dimmer or a digital type of dimmer. Those skilled in the art will also appreciate that the shape of the waveforms may be different, thus, the operating points, detection voltages, and threshold voltages of circuits 11, 35, and 45 may be different for other embodiments of dimmer 13. One of ordinary skill in the art will further understand that the waveforms illustrated in FIG. 3 will have different shapes for different conduction angles and different amounts of phase cut.

In operation for example embodiment where dimmer 13 is a front end dimmer and assuming that an a.c. cycle from source 15 begins at substantially zero volts (0V) at a time T0, output 31 of bridge 14 is also at substantially zero volts (0V), thus, the voltage applied across source 11 and circuit 45 is substantially zero volts (0 V). Consequently, currents 42 and 43 are substantially zero as illustrated by plot 64. At a time just after T0, when input signal 15 increases but the triac inside dimmer 13 has not yet fired a small voltage passes through dimmer 13 to circuit 35 and source 11. At this time, just after T0, a small current must be conducted to keep dimmer 13 in correct operation. The small aforementioned voltage will be seen by regulator 19 in series with the closed switch and load 27. If the input voltage from source 15 is greater than the threshold voltage of the source 11 when the triac conducts then current 43 is non-zero when the triac fires and the switch circuit turns off current 44. If the input voltage from source 15 is less than the threshold voltage of the source 11 when the triac conducts, as in T1, then current 44 holds dimmer 13 on and lets the input voltage on input 37 rise until the threshold voltage of the source 11 is reached. Once the threshold voltage of the source 11 is reached then current 43 is non zero and is limited by regulator 19.

As the voltage of the input signal increases between T0 and a time T1, dimmer 13 has not yet fired the triac or other circuits that are internal to dimmer 13. Thus, dimmer 13 needs a small holding current to operate the circuits internal to dimmer 13. The voltage necessary to operate regulator 19 is negligible and is ignored in FIG. 3. The voltage supplied by bridge 14 is a function of what specific make an model dimmer that is used, but this non-zero voltage is not enough to overcome the threshold voltage required to operate source 11, thus, current 43 is also substantially zero. Consequently, the current sense signal on input 36 of circuit 45 is pulled high through a current sense resistor 34 and transistor 47 of circuit 45 is disabled. With transistor 47 disabled, the base of transistor 50 of circuit 45 is pulled low through a resistor 48 of circuit 45 which enables transistor 50 to conduct current 44. Thus, the current detect circuit forms a current detect signal 49 representing the detection of substantially the absence of current 43. Current detect signal 49 is similar to signal 22 of FIG. 1. Current 44 flows through transistor 50 and output 39 to load 27, illustrated in this embodiment by a resistor. Load 27 and resistor 48 are selected, such as the value of the resistor, so that current 44 is large enough for biasing dimmer 13 to provide proper operation for dimmer 13. The voltage across source 11 and circuit 45 also increases but not enough to equal or exceed the threshold voltage of circuit 11. At some point, such as time T1, triac 13 fires and dimmer 13 begins to conduct. Dimmer 13 passes the full voltage of source 15 to circuit 35. At T1, in this particular example of the front end dimmer, the voltage of source 15 is less than the threshold voltage of circuit 11, thus, current 43 remains substantially zero and the current sense signal on input 36 remains high. Current 44 continues to flow to supply bias current to dimmer 13 in order to maintain dimmer 13 conducting. If the circuit internal to dimmer 13 were to conduct later, at a high enough voltage to conduct current through the circuit 11, the value of current 44 would continue to keep dimmer 13 in a high impedance state until dimmer 13 conducts and the value of current 43 would hold the internal dimmer 13 circuits in a conductive state.

The voltage of the input signal continues to increase as illustrated by plot 60 from T1 to a time T2, where the voltage on output 20 becomes at least equal to the threshold voltage of source 11 and current 43 begins to flow through resistor 34 and source 11 as illustrated by plot 64 at time T2. Current 43 through resistor 34 forms a current sense signal that is received on input 36 of circuit 45. The current sense signal is representative of current 43 flowing through source 11. The current sense signal enables transistor 47 which pulls the base of transistor 50 high thereby disabling transistor 50. Thus, the current detect circuit forms current detect signal 49 to represent the detection of current 43. Disabling transistor 50 opens the switch thereby terminating current 44 as illustrated by plot 63 at time T2. As long as the input voltage from bridge 14 is greater than the threshold voltage of source 11, current 43 continues to flow and current 44 is substantially zero, as illustrated by plots 63 and 64 between time T2 and a time T3. Those skilled in the art will appreciate that there may be some leakage current flow through transistor 50 when transistor 50 is disabled but such leakage current is very small in comparison to the value when transistor 50 is enabled, thus, substantially zero includes flow of the leakage current. Those skilled in the art will also understand that in some embodiments, some small amount of current may flow through source 11 before current 43 is large enough to have a first value that is sufficient to form a voltage across resistor 34 that is greater than the base-emitter voltage of transistor 47, however, that amount of current is usually is small in comparison to the current required to form visible light from source 11. Thus, one skilled in the art understands that in such an embodiment, circuit 35 is configured to receive the current sense signal and enable transistor 50 in response to current flow through the LED light source that is less than the first value, such as a value that is sufficient for visible light, in order to form current 44 and that circuit 35 is also configured to disable transistor 50 in response to current flow through the LED light source being greater than the first value. The value of resistor 34 is usually chosen to be a small value in order to minimize power dissipation of system 30. Additionally, the value of resistor 48 usually is chosen to be very large in order to minimize power dissipation when current 43 is flowing, but small enough to put transistor 50 into saturation to minimize power dissipation.

At time T3, the voltage on input 37 becomes less than the threshold voltage of source 11 and current 43 no longer flows. Without current 43, the current sense signal is removed and input 36 is again pulled to the voltage on output 20 of regulator 19, thus, the base of transistor 47 is again a voltage that disables transistor 47 thereby enabling transistor 50 to conduct current 44 as illustrated by plot 63 at time T3. As can be seen, transistor 47 along with resistor 48 function as a current detect circuit that provides a control signal indicating the detection of current 43, and transistor 50 functions as a switch that selectively enables and disables the flow of current 44 responsively to, respectively, detecting substantially an absence of current 43 or detecting current 43. Resistor 34 functions as a current sense element that provides a current sense signal indicating the flow of current 43.

At time T3, current 44 continues to flow, to keep dimmer 13 in operation and prepared for the second cycle, but decreases in value as the value of the a.c. signal from source 15 decreases to zero for this half cycle of the a.c. signal thereby causing the input signal to also decease as illustrated by plot 62 between T3 and a time T4.

For the negative cycle of the a.c. signal from source 15, circuit 35 and source 11 operate as explained for the positive cycle of the a.c. signal as illustrated by FIG. 2 between T4 and a time T5.

Those skilled in the art will appreciate that circuit 45 and load 27 are sometimes referred to as a dynamic dummy load because circuit 45 selectively forms a current for load 27 responsively to not detecting current flow (thus detecting substantially no current flow) through source 11. Those skilled in the art will also appreciate that transistor 50 and/or transistor 47 may be a P-channel MOS transistor.

Those skilled in the art will appreciate that detecting current flow through the LED light source to control the dynamic dummy load instead of using a value of a voltage across the LED light source facilitates forming circuit 35 to be independent of the threshold voltage of the LED light source, thus, independent of the number of LEDs that are connected in series since the threshold voltage is a function of the number of series connected LEDs but the value of the current is independent of the number of series connected LEDs. Additionally, the control circuit does not regulate the value of the voltage supplied to the LEDs but only controls the current through the LEDs.

Figure 4:
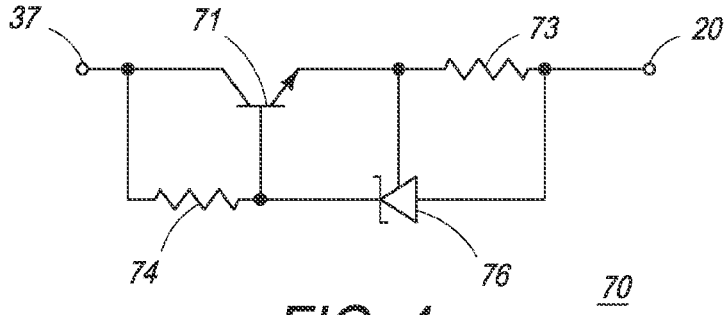
FIG. 4 schematically illustrates an example of a portion of an embodiment of a current regulator circuit that may be used with the circuits of FIG. 1 or FIG. 2 in accordance with the present invention.

FIG. 4 schematically illustrates an example of a portion of an embodiment of a current regulator circuit 70 that may be used for current regulator 19.

Circuit 70 includes a control transistor 71, a current sense resistor 73, a startup resistor 74, and a reference circuit 76.

Reference circuit 76 can be any of several well-known reference circuits such as a shunt regulator or precision reference. One example of a circuit that is suitable for circuit 76 is an NCP431 that is available from ON Semiconductor of 5005 E. McDowell Road, Phoenix, Ariz. When the voltage on input 37 is sufficient for operation of circuit 70, resistor 74 provides a startup voltage to enable transistor 71. Transistor 71 begins to conductor current 42 and forms a current sense voltage across resistor 73. The current control circuit receives the voltage across resistor 73 as representative of the value of current 42 and regulates the value of current 42 to a desired value that is represented by the voltage from reference circuit 76. For voltage values of the input signal on input 37 that are less than required for forming the desired value of current 42, circuit 70 increases the value of current 42 as the input signal increases as illustrated by plot 63 from time T1 to T2.

Figure 5:
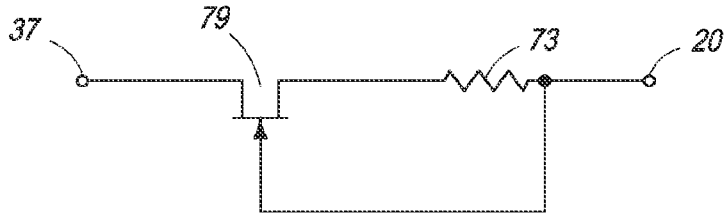
FIG. 5 schematically illustrates an example of a portion of an embodiment of another current regulator circuit that may be used with the circuits of FIG. 1 or FIG. 2 in accordance with the present invention.

FIG. 5 schematically illustrates an example of a portion of an embodiment of a current regulator circuit 78 that may be used for current regulator 19. Circuit 78 includes a J-FET transistor 79 coupled to receive the input voltage and form current 42. Initially transistor 79 is in a low impedance state until a desired current 42 flows through a resistor 73 and creates a negative voltage on the gate of transistor 79 thereby creating a pinch-off region and regulating current 42.

Figure 6:
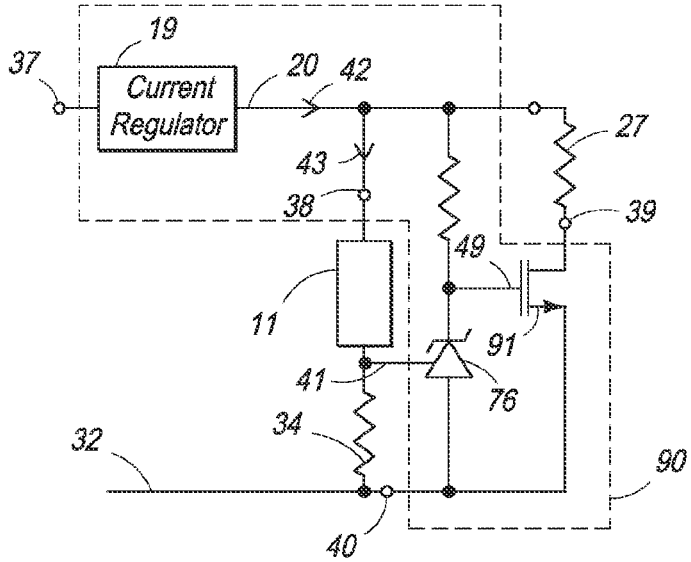
FIG. 6 schematically illustrates an example of an embodiment of a portion of an LED lighting system that is an alternate embodiment of the system of FIGS. 1 and or 2 in accordance with the present invention.

FIG. 6 schematically illustrates an example of an embodiment of a portion of an LED lighting system that includes an LED control circuit 90 that is configured to operate similarly to circuits 17 and or 35. Circuit 90 includes an N-channel MOS transistor 91 that functions similarly to transistor 50. Those skilled in the art will appreciate that transistor 91 may also be an NPN bipolar transistor and precision reference 76 would function similarly to transistor 47.

Figure 7:
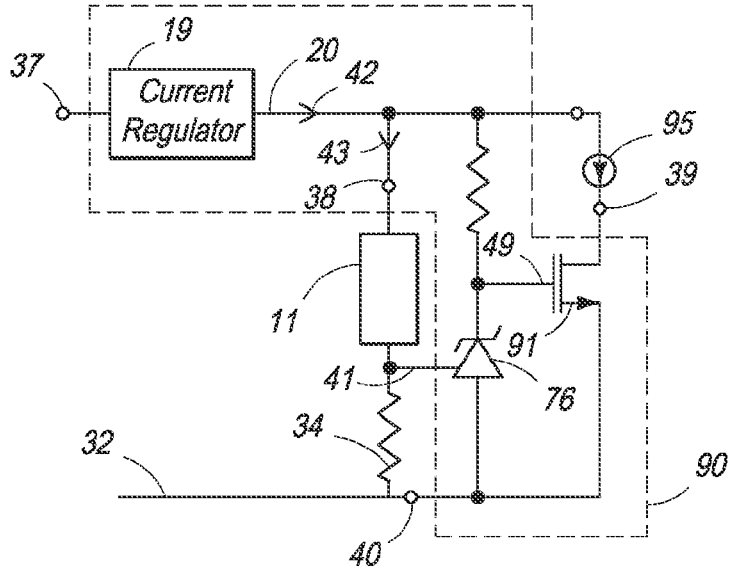
FIG. 7 schematically illustrates an example of a portion of another embodiment of an LED lighting system that is an alternate embodiment of the system of FIGS. 1 and or 2 in accordance with the present invention.

FIG. 7 schematically illustrates an example of an embodiment of a portion of an LED lighting system including a current regulator 95 used as the dummy load. Regulator 95 may be any of a variety of well-known circuits that may including any of circuits 70 and/or 78.

Figure 8:
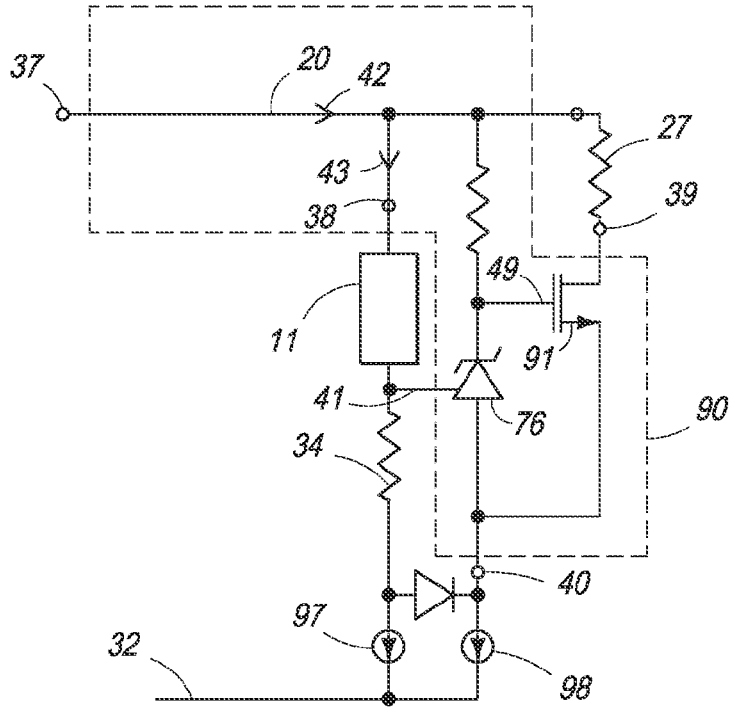
FIG. 8 schematically illustrates an example of a portion of yet another embodiment of an LED lighting system that is an alternate embodiment of the system of FIGS. 1 and or 2 in accordance with the present invention in accordance with the present invention.

FIG. 8 schematically illustrates an example of an embodiment of a portion of an LED lighting system including current regulators 97 and 98 used to set two different levels of current instead of the single current set be regulator 19. Regulator 98 is set to a current level lower than regulator 97 to load the dimmer through resistor 27. The current in regulator 97 in addition to the current in regulator 98 combine to form current 43. Regulators 97 and 98 may be any of a variety of well-known circuits including regulator 76, or any of circuits 70 and/or 78.

Figure 9:
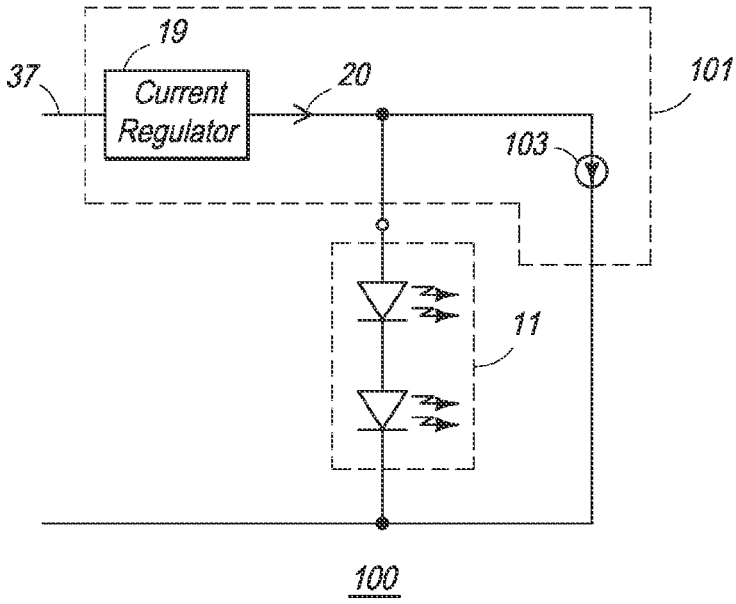
FIG. 9 schematically illustrates an example of a portion of yet another embodiment of an LED lighting system that is an alternate embodiment of the system of FIGS. 1 and or 2.

FIG. 9 schematically illustrates an embodiment of an LED lighting system 100 that includes current regulator 19, source 11, and a dummy load 103. By simply placing a dummy load 103 in parallel to source 11 dummy load 103 will independently regulate dimmer 13 while simultaneously saving power because the current through dummy load 103 is regulated through current regulator 19. Dummy load 103 is connected directly in parallel with source 11 and is not connected in parallel with regulator 19. For the embodiment illustrated n FIG. 9, dummy load 103 is a current source. In some embodiments, dummy load 103 may be a resistor instead of a current source.

Figure 10:
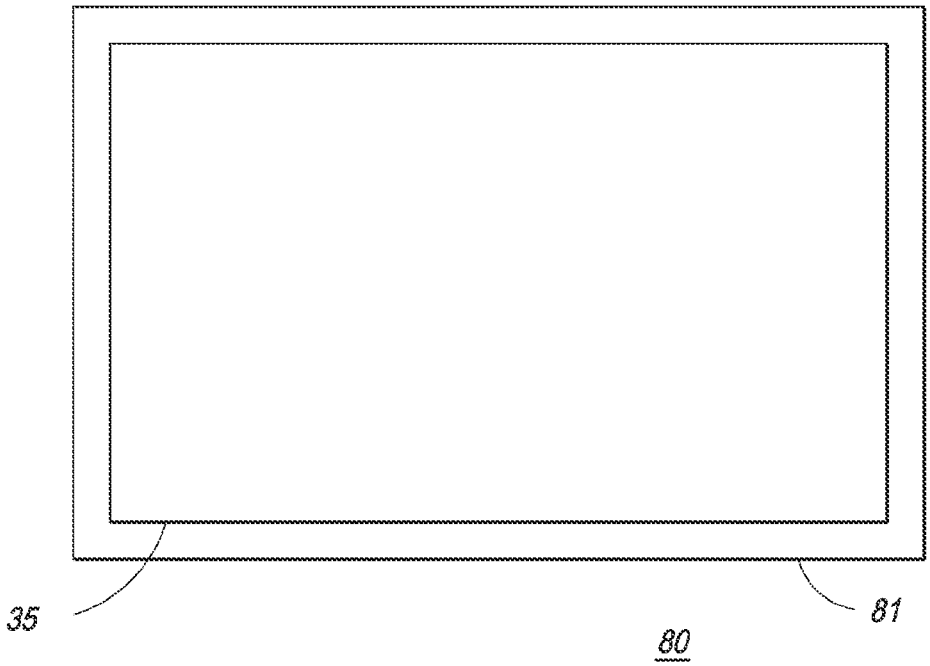
FIG. 10 illustrates an enlarged plan view of a semiconductor device that includes the LED control circuit of FIG. 1 or FIG. 2 in accordance with the present invention.

FIG. 10 illustrates an enlarged plan view of a portion of an embodiment of a semiconductor device or integrated circuit 80 that is formed on a semiconductor die 81. Circuit 35 or circuit 90 may be formed on die 81. Die 81 may also include other circuits that are not shown in FIG. 5 for simplicity of the drawing. Circuits 35 or 90 and device or integrated circuit 80 are formed on die 81 by semiconductor manufacturing techniques that are well known to those skilled in the art. In one embodiment, circuit 35 is formed on a semiconductor substrate as an integrated circuit having five external leads, such as inputs 36 and 37, outputs 38 and 39, and return 40. In another embodiment, load 27 may be internal to circuit 35 and to die 81 thereby reducing the number of external leads, such as eliminating output 39. In yet another embodiment, the current sense element may be internal to circuit 35. In such an embodiment, input 36 may not be required.

While the subject matter of the descriptions are described with specific preferred embodiments and example embodiments, the foregoing drawings and descriptions thereof depict only typical and exemplary embodiments of the subject matter and are not therefore to be considered to be limiting of its scope, it is evident that many alternatives and variations will be apparent to those skilled in the art. Those skilled in the art will appreciate that the exemplary form of circuit 35 and the current sense circuit are used as a vehicle to explain the operation method of detecting the LED current flow and to explain the preferred operational embodiment of circuit 35 and the current sense circuit. As is well understood by those skilled in the art, other embodiments could provide similar operation as long as the current sense circuit forms a current sense signal that indicates or detects current flow through an LED light source, for example source 11, and as long as circuit 35 is configured to form current 44 responsively to detecting substantially an absence of current flow through the LED light source (and in one embodiment current flow below a value that forms visible light from the light source) and to substantially terminate current 44 responsively to detecting current flow through the LED light source (and in one embodiment current flow above a value that forms visible light from the light source). In some embodiments, resistor 34 may be a MOSFET or a bipolar transistor to reduce power dissipation.

Additionally, load 27, illustrated by a resistor, may have other embodiments including a diode having an anode connected to output 39, or a diode connected transistor. For such an embodiment, the value of current 44 typically is the maximum value of current that can be supplied by regulator 19. Load 27 may also have other embodiments including a current regulator. Although transistors 47, 50, and 71 are illustrated as respective bipolar transistors, those skilled in the art will understand that they may also be MOS transistors.

From all the foregoing one skilled in the art can determinate that according to one embodiment, a method of forming an LED control circuit comprises: configuring the LED control circuit, for example circuit 17 or 35, to receive an input signal from a dimmer and to form an LED current, such as current 43 for example, to operate an LED light source; configuring the LED control circuit to detect the LED current flowing through the LED light source and to detect an absence of the LED current flowing through the LED light source; and configuring the LED control circuit to form a bias current, such as current 44 for example, responsively to detecting the absence of the LED current to the LED light source including configuring the LED control circuit to and supply the bias current to a dummy load, such as load 27 for example, and configuring the LED control circuit to terminate the bias current responsively to detecting the LED current.

Another embodiment of the method may also include configuring the LED control circuit to form the LED current responsively to the input signal having a voltage that is greater than a threshold value of the LED light source.

Those skilled in the art will appreciate that another embodiment may include, an LED control circuit, such as circuit 17 or 35) comprising: an input, input 37 for example, configured to receive a rectified signal from a dimmer circuit as an input signal; a current regulator configured receive the input signal and provide an output current, such as current 42; an LED output, such as output 38, of the LED control circuit configured to supply an LED current, such as current 43, to an LED light source; a current detect circuit, such as circuit 21, configured to receive a current sense signal representative of current flow through the LED light source and form a current detect signal, such as signal 22, representing detection of current flow through the LED light source; and a switch configured, such as switch 23, to form a bias current responsively to detection of an absence of the LED current and configured to terminate the bias current responsively to detection of the LED current.

According to another embodiment, the LED control circuit may include a load output, such as output 39, of the LED control circuit configured for coupling to a dummy load to supply the bias current to the dummy load wherein the load output is configured to couple the dummy load in series with the switch and configured to couple the combination thereof in parallel with the LED light source.

In another embodiment, the LED control circuit may further include a switch transistor, transistor 50 for example, having a control electrode coupled to receive the current detect signal, a first current carrying electrode coupled to receive the bias current and coupled to the first current carrying electrode of the first transistor, and a second current carrying electrode configured to couple the bias current to a dummy load.

According to another embodiment, the current detect circuit may also include a first transistor, such as transistor 47, having a control electrode coupled to receive the current sense signal, a first current carrying electrode coupled to receive the output current from the current regulator, and a second current carrying electrode configured to form the current detect signal.

In yet another embodiment, the LED control circuit may further include a switch transistor, such as transistor 50, having a control electrode coupled to receive the current detect signal, a first current carrying electrode coupled to receive the bias current and coupled to the first current carrying electrode of the first transistor, and a second current carrying electrode configured to couple the bias current to a dummy load.

Those skilled in the art will also understand that in another embodiment, a method of forming an LED control circuit comprises: configuring the LED control circuit, such as circuit 17 or 35, to receive a rectified signal from a dimmer circuit, such as signal 37, as an input signal and form an LED current, such as current 43, for an LED light source; configuring the LED control circuit to receive a current sense signal representative of current flow through the LED light source; configuring the LED control circuit to form a current detect signal, such as signal 49, having a first state, for example either low or high, that is representative of current flow through the LED light source and having a second state, that is opposite to the first state, that is representative of detecting an absence of current flow through the LED light source; configuring the LED control circuit to supply a bias current for a dummy load responsively to detecting the absence of current flow through the LED light source; and configuring the LED control circuit to terminate the bias current responsively to detecting current flow through the LED light source.

In another embodiment, the method may include configuring the LED control circuit to enable a switch transistor, such as transistor 50, to conduct the bias current to the dummy load responsively to detecting an absence of current flow through the LED light source and to terminate conducting the bias current responsively to detecting current flow through the LED light source.

Another embodiment of the method may include configuring the LED control circuit to receive the current sense signal and enable a first transistor, transistor 47 for example, to form the first state in response to current flow through the LED light source that is greater than a first value and to disable the first transistor to form the second state in response to current flow through the LED light source being less than the first value Yet another embodiment may further include, configuring the LED control circuit to receive the current sense signal, such as signal 25, and enable a switch transistor, such as transistor 50, in response to current flow through the LED light source that is less than the first value, such as less than the value when the light source is operating, to form the bias current and to disable the switch transistor in response to current flow through the LED light source being greater than the first value.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

In view of all of the above, it is evident that a novel device and method is disclosed. Included, among other features, is configuring an LED control circuit to detect an LED current flowing through an LED light source and to not form a bias current while the LED current is flowing (for example, flowing sufficiently to form visible light from the LED light source) and configuring an LED control circuit to detect the absence of the LED current flowing through the LED light source (for example detect current less than a value sufficient to form visible light from the LED light source). Detecting the current facilitates the LED control circuit operation not having the threshold voltage of the LED light source as a design parameter of the LED control circuit and terminating the value of the bias voltage assists in reducing the power dissipation of the LED control circuit and the associated LED system.

The invention claimed is:

1. An LED control circuit comprising:

an input configured to receive a rectified signal from a dimmer circuit as an input signal;

a current regulator configured receive the input signal and provide an output current;

an LED output of the LED control circuit configured to supply an LED current to an LED light source;

a current detect circuit configured to receive a current sense signal representative of current flow through the LED light source and form a current detect signal representing detection of current flow through the LED light source; and a switch configured to form a bias current responsively to detection of an absence of the LED current and configured to terminate the bias current responsively to detection of the LED current.

2. The LED control circuit of claim 1 further including a load output of the LED control circuit configured for coupling to a dummy load to supply the bias current to the dummy load wherein the load output is configured to couple the dummy load in series with the switch and configured to couple the combination thereof in parallel with the LED light source.

3. The LED control circuit of claim 1 wherein the current detect circuit includes a first transistor having a control electrode coupled to receive the current sense signal, a first current carrying electrode coupled to receive the output current from the current regulator, and a second current carrying electrode configured to form the current detect signal.

4. The LED control circuit of claim 3 further including a switch transistor having a control electrode coupled to receive the current detect signal, a first current carrying electrode coupled to receive the bias current and coupled to the first current carrying electrode of the first transistor, and a second current carrying electrode configured to couple the bias current to a dummy load.

5. The LED control circuit of claim 4 further including a dummy load coupled to receive the bias current from the switch.

6. The LED control circuit of claim 4 further including a first resistor having a first terminal coupled to the second current carrying electrode of the first transistor.

7. The LED control circuit of claim 1 wherein the LED output is also configured to supply the LED current to a current sense resistor.

8. A method of forming an LED control circuit comprising:

configuring the LED control circuit to receive a rectified signal from a dimmer circuit as an input signal and form an LED current for an LED light source;

configuring the LED control circuit to receive a current sense signal representative of current flow through the LED light source;

configuring the LED control circuit to form a current detect signal having a first state that is representative of current flow through the LED light source and having a second state that is representative of detecting an absence of current flow through the LED light source;

configuring the LED control circuit to supply a bias current for a dummy load responsively to detecting the absence of current flow through the LED light source; and configuring the LED control circuit to terminate the bias current responsively to detecting current flow through the LED light source.

9. The method of claim 8 wherein configuring the LED control circuit to supply the bias current for the dummy load includes configuring the LED control circuit to enable a switch transistor to conduct the bias current to the dummy load responsively to detecting an absence of current flow through the LED light source and to terminate conducting the bias current responsively to detecting current flow through the LED light source.

10. The method of claim 8 wherein configuring the LED control circuit to form the current detect signal having the first state includes configuring the LED control circuit to receive the current sense signal and enable a first transistor to form the first state in response to current flow through the LED light source that is greater than a first value and to disable the first transistor to form the second state in response to current flow through the LED light source being less than the first value.

11. The method of claim 10 including configuring the LED control circuit to receive the current sense signal and enable a switch transistor in response to current flow through the LED light source that is less than the first value to form the bias current and to disable the switch transistor in response to current flow through the LED light source being greater than the first value.

12. The method of claim 10 further including coupling a control electrode of the first transistor to receive the current sense signal, coupling a first current carrying electrode of the first transistor to receive a current from a current regulator, and configuring a second current carrying electrode to form the current detect signal.

13. The method of claim 12 further including coupling a control electrode of the switch transistor to receive the current detect signal, coupling a first current carrying electrode of the switch transistor to receive the bias current, and configuring a second current carrying electrode to couple the bias current to a dummy load.

14. A method of forming an LED control circuit comprising:

configuring the LED control circuit to receive an input signal from a dimmer and to form an LED current to operate an LED light source;

configuring the LED control circuit to detect the LED current flowing through the LED light source and to detect an absence of the LED current flowing through the LED light source; and configuring the LED control circuit to form a bias current responsively to detecting the absence of the LED current to the LED light source including configuring the LED control circuit to and supply the bias current to a dummy load, and configuring the LED control circuit to terminate the bias current responsively to detecting the LED current.

15. The method of claim 14 further including configuring the LED control circuit to form the LED current responsively to the input signal having a voltage that is greater than a threshold value of the LED light source.

16. The method of claim 14 wherein configuring the LED control circuit to detect the LED current flowing through the LED light source and to detect the absence of the LED current includes configuring the LED control circuit to receive a current sense signal that is representative of current flow through the LED light source and to assert a current detect signal responsively to the LED current being no less than a first value and to negate the current detect signal responsively to the LED current being less than the first value.

17. The method of claim 14 further including configuring the LED control circuit to enable a switch to conduct the bias current to the dummy load responsively to the negated current detect signal and to disable the switch to terminate the bias current to the dummy load responsively to the asserted current detect signal.

* * * * *